US007097497B2

(12) United States Patent
Kikuchi

(10) Patent No.: US 7,097,497 B2
(45) Date of Patent: Aug. 29, 2006

(54) PLUG FOR SPEAKER CABLES, AND SPEAKER TERMINAL AND SPEAKER TERMINAL SYSTEM PROVIDED WITH THEM

(75) Inventor: Eiji Kikuchi, Tokyo (JP)

(73) Assignee: Nippon Dics Co., Ltd., Tokyo (JP)

( * ) Notice: Subject to any disclaimer, the term of this patent is extended or adjusted under 35 U.S.C. 154(b) by 0 days.

(21) Appl. No.: 10/776,258

(22) Filed: Feb. 12, 2004

(65) Prior Publication Data

US 2004/0161962 A1 Aug. 19, 2004

Related U.S. Application Data

(62) Division of application No. 10/252,094, filed on Sep. 23, 2002, now Pat. No. 6,719,581.

(30) Foreign Application Priority Data

Jul. 25, 2002 (JP) ..... 2002-216452

(51) Int. Cl.
*H01R 13/60* (2006.01)

(52) U.S. Cl. ..... 439/541.5; 439/491; 439/924.1

(58) Field of Classification Search ..... 439/541.5, 439/491, 924.1, 676, 680, 607, 488, 692
See application file for complete search history.

(56) References Cited

U.S. PATENT DOCUMENTS 5,176,528 A * 1/1993 Fry et al. ..... 439/181
5,417,585 A * 5/1995 Morin et al. ..... 439/488
5,685,735 A 11/1997 Hohorst ..... 439/441
5,915,991 A 6/1999 Roman ..... 439/441
6,036,549 A * 3/2000 Wulff ..... 439/660
6,056,594 A * 5/2000 Ching ..... 439/541.5
6,146,187 A 11/2000 Pallai ..... 439/441
6,168,446 B1 * 1/2001 Tung ..... 439/159
6,264,501 B1 * 7/2001 Hung et al. ..... 439/541.5
6,447,340 B1 * 9/2002 Wu ..... 439/660
6,540,564 B1 * 4/2003 Ko ..... 439/676
6,579,121 B1 * 6/2003 Belopolsky ..... 439/541.5
6,592,392 B1 * 7/2003 Po-Heng ..... 439/358
6,609,929 B1 * 8/2003 Kamarauskas et al. .. 439/541.5
6,736,680 B1 * 5/2004 Slack et al. ..... 439/676
6,749,470 B1 * 6/2004 Dangelmaier ..... 439/857
2004/0248467 A1 * 12/2004 Herlitz et al. ..... 439/607

FOREIGN PATENT DOCUMENTS

JP 2002-075485 3/2002

* cited by examiner

*Primary Examiner*—Gary F. Paumen
(74) *Attorney, Agent, or Firm*—Westerman, Hattori, Daniels & Adrian, LLP.

(57) ABSTRACT

A plug for the speaker cables of the invention comprises a plug main body involving terminal loading slots for positive and negative polarities on the front thereof, loading slots for cables in response to both polarities on the rear thereof, and a hollow inside thereof, wherein first tongues for holding terminals functioning to hold speaker terminals are inserted from the terminal loading slots from the external surface thereof by spring action, second tongues for holding cables connected to the tongues for holding terminals and functioning to hold stranded wires of speaker cables are inserted from the cable loading slots from the external surface thereof by spring action, and third tongues for holding cables are formed so as to expand sections for holding cables by operating pieces disposed so as to be exposed outside the plug main body.

6 Claims, 8 Drawing Sheets

A: STATE PRIOR TO CONNECTION

B: PUSHES UP OPERATING PIECE 7a FOR RELEASE

C: INSERT CABLE IN STATE WHILE MAINTAINING STATE OF PUSHING UP OPERATING PIECE 7a FOR RELEASE

D: OPERATING PIECE 7a FOR RELEASE IS LIBERATED: STATE OF COMPLETING CONNECTION

PLUG FOR SPEAKER CABLES, AND SPEAKER TERMINAL AND SPEAKER TERMINAL SYSTEM PROVIDED WITH THEM

This application is a divisional application of prior application Ser. No. 10/252,094 filed Sep. 23, 2002 now U.S. Pat. No. 6,719,581.

BACKGROUND OF THE INVENTION

1. Field of the Invention

The present invention relates to a plug for speaker cables, and a speaker terminal by which the speaker cables for respective channels can be connected easily and exactly to the multichannel speaker terminal in an audiovisual field such as a home theater system and to a speaker terminal system composed of the plug and the terminals.

2. Description of the Related Art

In recent years, the so-called home theater system by which the impact and sense of movie-like reality, that is, the sensation of a movie theater, has become widely prevalent. In a home theater system, a screen image is projected on a big screen in cooperation with acoustic effects in a delicate, highly real, and powerful manner, delivered from multichannel speakers, e.g., 5.1 channel speakers, which correspond to the screen image so that spectators can enjoy a screen image and acoustic effects which cannot be achieved by a conventional audio system. Accordingly, such a powerful home theater system as mentioned above is expected to become widely used rapidly.

In the above-described system, however, since a number of loud speakers having various sizes are used for realizing such impressive acoustic effects in multiple channels, there is such a problem that not only are connecting operations complicated just in the case where the connection for respective loud speakers is made by the use of terminals of a conventional lever type or the like, but also erroneous connection arises easily because the system involves multiple channels and multiple speakers.

SUMMARY OF THE INVENTION

The present invention has been made in view of the facts described above. Accordingly, objects of the present invention is to provide a plug for speaker cables by which loud speakers can be connected easily with the appropriate speaker terminals of an amplifier or the like, so that there arises no erroneous connection or the like in an audio system, such as the above-described home theater system, wherein loud speakers of various sizes are used in multiple channels and to provide speaker terminals disposed on an amplifier side for connecting to the plug, and to provide a terminal system provided with the above-described plug and terminals.

According to the present invention, a plug for the speaker cables of the invention comprises a plug main body involving terminal loading slots for positive and negative polarities on the front thereof, loading slots for cables in response to both polarities on the rear thereof, and a hollow inside thereof; tongues for holding terminals functioning to hold speaker terminals inserted from the terminal loading slots from the external surface thereof by spring action; tongues for holding cables connected to the tongues for holding terminals and functioning to hold stranded wires of speaker cables inserted from the cable loading slots from the external surface thereof by spring action; and the tongues for holding cables being formed so as to expand sections for holding cables by operating pieces disposed so as to be exposed outside the plug main body, respectively.

Furthermore, according to the present invention, in the plug for speaker cables as described above, an engaging lever may be disposed on an external surface of a side on which terminal loading slots are provided, and the engaging lever is inserted into a plug loading slot while bending elastically to be engaged when the plug is inserted into the plug loading slot provided with output terminals or input terminals for loud speakers disposed on an amplifier or the like. Moreover, according to the present invention, in the plug for speaker cables as described above, a right sectional shape of the plug for speaker cables may be formed into vertically or horizontally asymmetrical contours, and a front shape of a plug loading slot on an amplifier or the like into which the plug is to be inserted is formed into an inside shape having the same section as that of an outside shape in the right section of the plug. Since a plug for speaker cables according to the present invention has been constituted as described above, connection polarities thereof are never inverted.

Furthermore, a speaker terminal according to the present invention comprises one or more plug loading slot having such a mode that the front end of which is opened into a substantially same sectional shape as a right sectional contour of a plug for speaker cables to be inserted to define the right sectional shape of an opening and recessed correspondingly; an engaging projection for latching and supporting an engaging portion of an engaging lever as part of a plug to be inserted and that is disposed on the front end of an opening edge in the respective plug loading slots; and contact pieces in terminals of positive and negative poles for a speaker being disposed on the inmost recessed wall surface of the plug loading slots so as to be horizontal with respect to the front end of the opening. Here, extreme ends of contact pieces in terminals of positive and negative poles may be disposed with a difference in their distances from the front end of the opening in the plug loading slots. Since a speaker terminal according to the present invention has been constituted as described above, noise can be avoided at the time of connection thereof. Also, it is arranged such that a test finger is not in contact with the contact piece in cooperation with a contour of the opening.

In the speaker terminal according to the present invention as described above, the respective plug loading slots for right and left channels may be disposed such that both of the plug loading slots are in symmetrical disposition. Since a speaker terminal according to the present invention has been constituted as described above, respective plug loading slots for right and left channels in plural channels can be arranged with good space efficiency, whereby the area for a terminal for connecting loud speakers can be reduced.

Further, in the speaker terminal according to the present invention as described above, front external surfaces of the plug loading slots for respective channels may be colored differently. Thus, erroneous connection of channels can be avoided. Besides, each shield plate may be disposed on the front surface thereof, except for each of the plug loading slots. Thus, a countermeasure for noise can be established.

BRIEF DESCRIPTION OF THE DRAWINGS

FIGS. 3A, 3B, 3C and 3D are explanatory views for illustrating each of states in which a speaker cable is connected to an example plug according to the present invention, wherein FIG. 3A is a side sectional view showing a state in which connection has not yet been made; FIG. 3B is a side sectional view showing a state in which an operating piece for releasing the cable has been pushed up by a finger; FIG. 3C is a side view showing a state in which the cable has been inserted into the plug while maintaining the state shown in FIG. 3B; and FIG. 3D is a side view showing a state in which the finger has been removed from the operating piece to complete a connection of the cable with the plug;

DETAILED DESCRIPTION OF THE PREFERRED EMBODIMENTS

Figure 1:
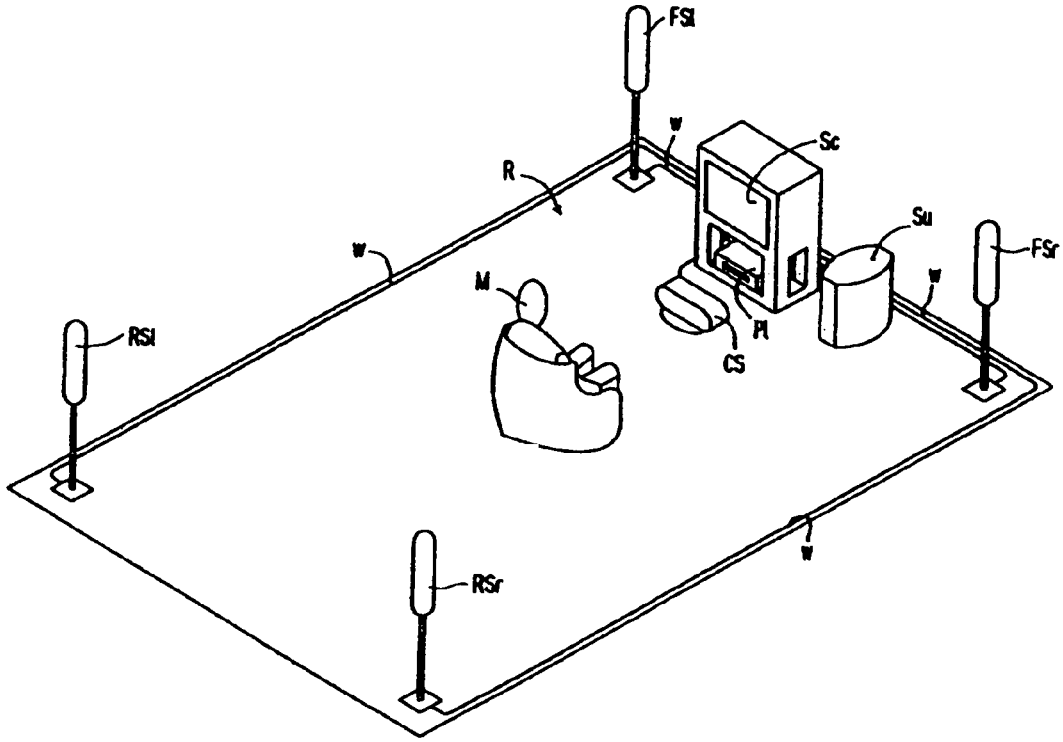
FIG. 1 is a perspective view showing schematically an outline of a home theater system.
Figure 2:
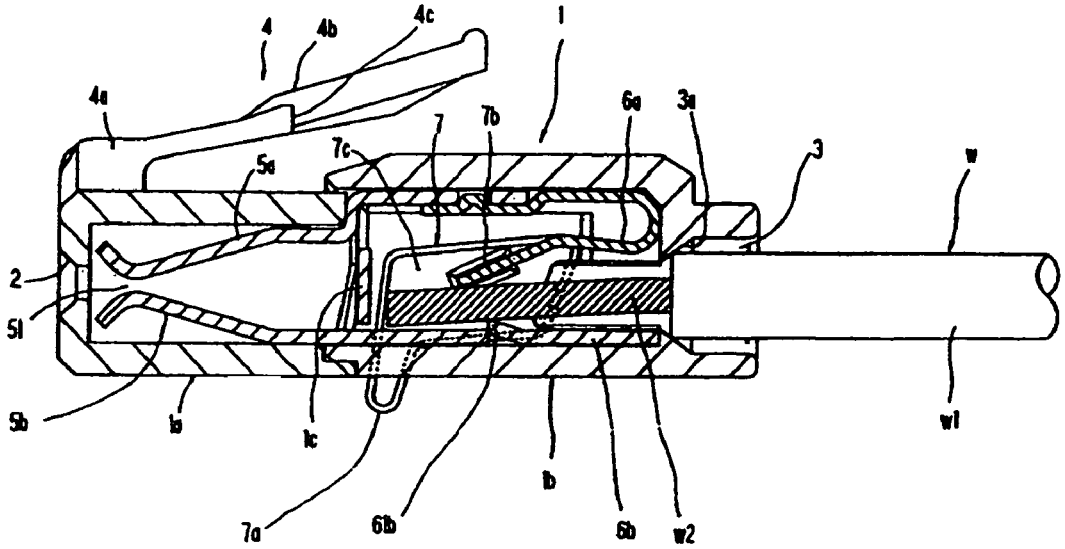
FIG. 2 is an enlarged side sectional view showing an example of a plug for speaker cables according to the present invention.
Figure 3:
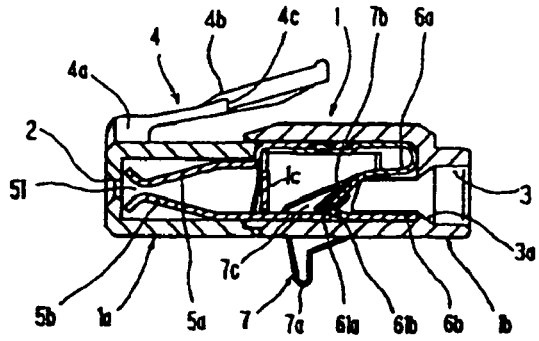
Figure 3:
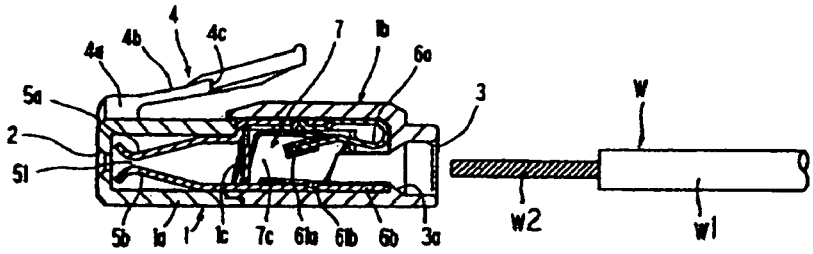
Figure 3:
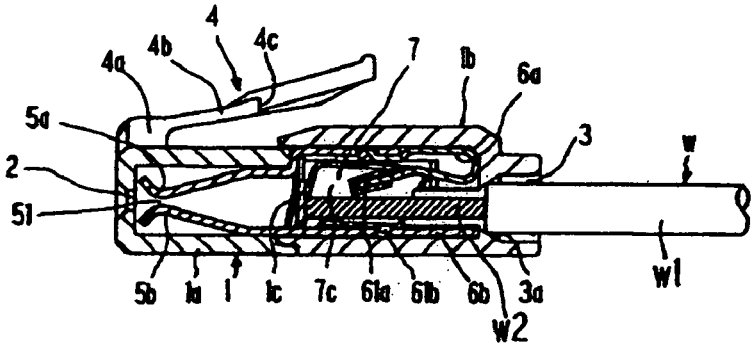
Figure 3:
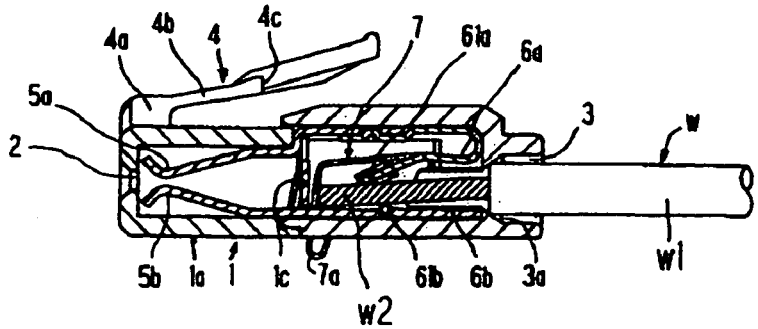
Figure 4:
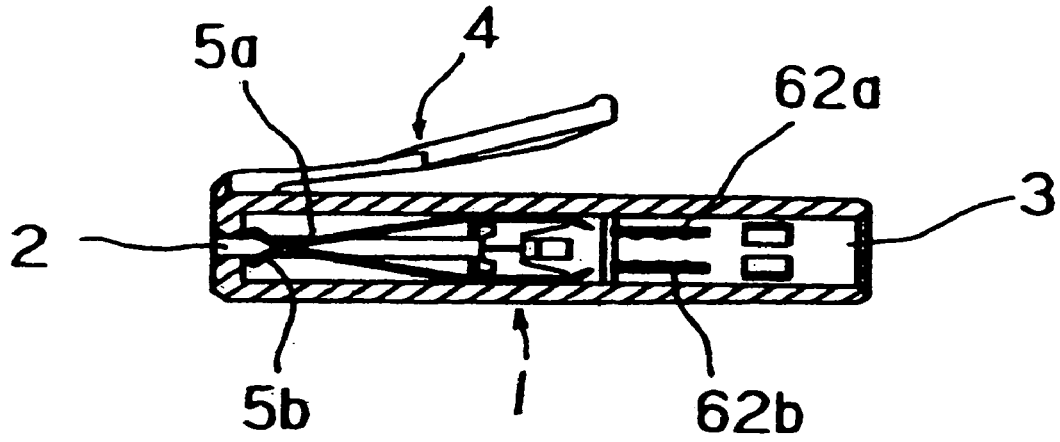
FIG. 4 is a sectional view showing a second example of a plug according to the present invention.
Figure 5:
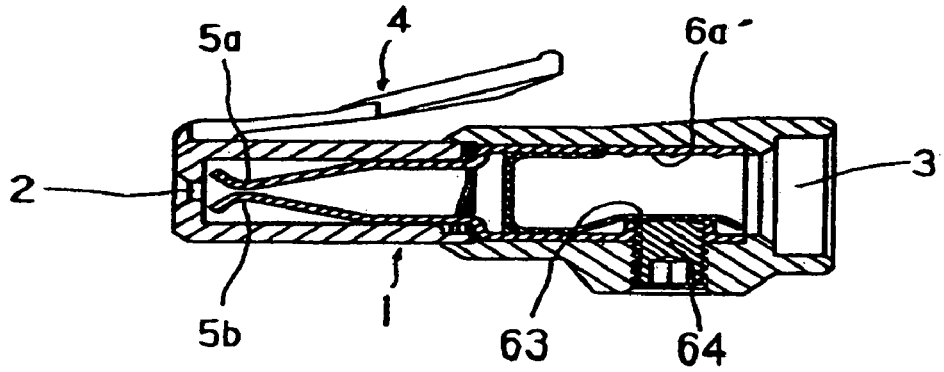
FIG. 5 is a sectional view showing a third example of a plug according to the present invention.
Figure 6:
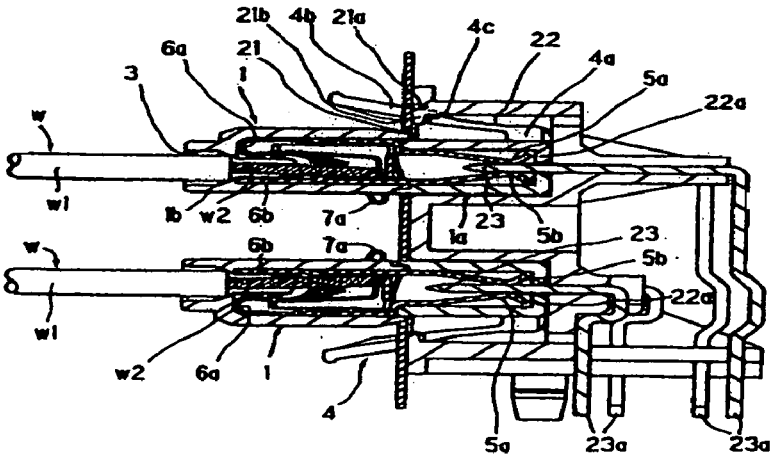
FIG. 6 is a sectional view showing a state wherein plugs of a first example according to the present invention are connected to a first example of a speaker terminal according to the present invention.
Figure 7:
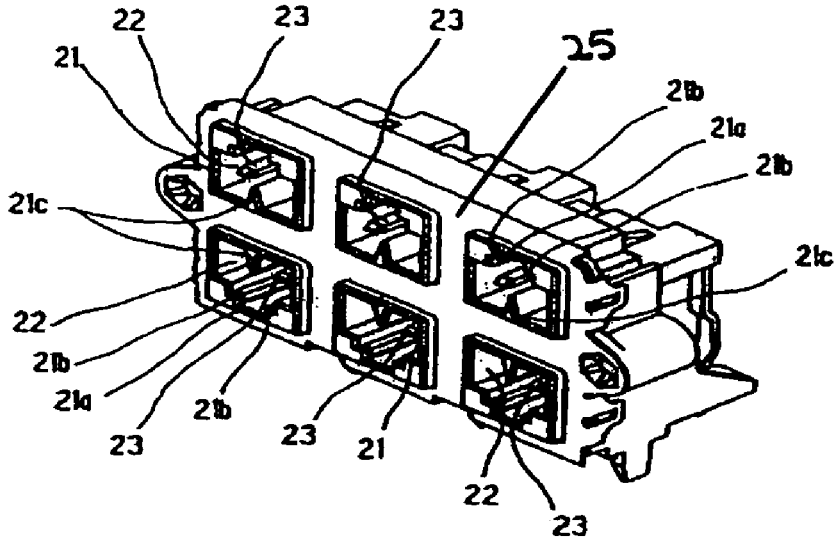
FIG. 7 is a perspective view showing the speaker terminal of FIG. 6.
Figure 8:
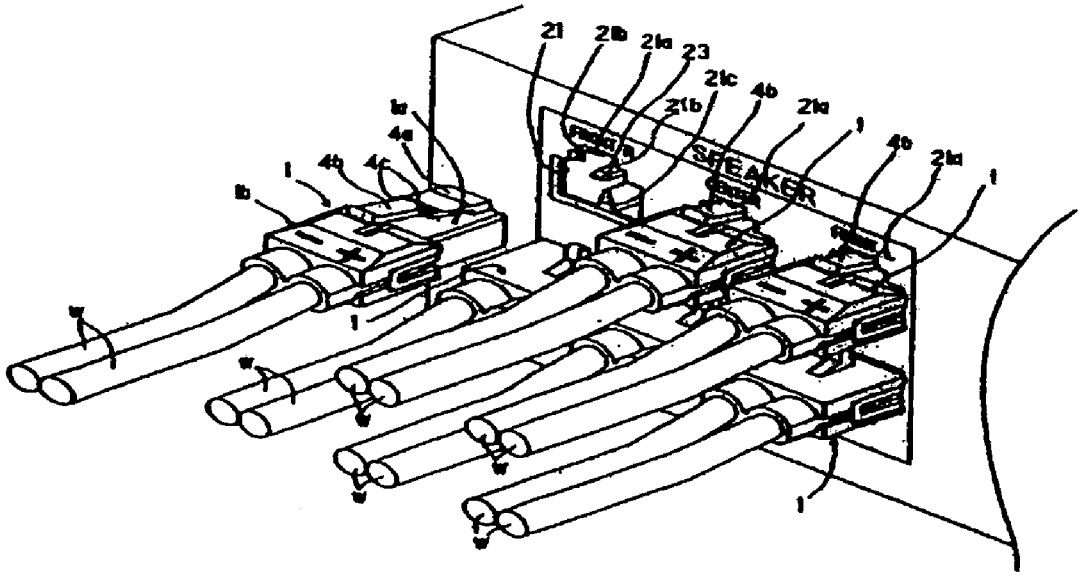
FIG. 8 is a perspective view showing a state of the connection of FIG. 6.
Figure 9:
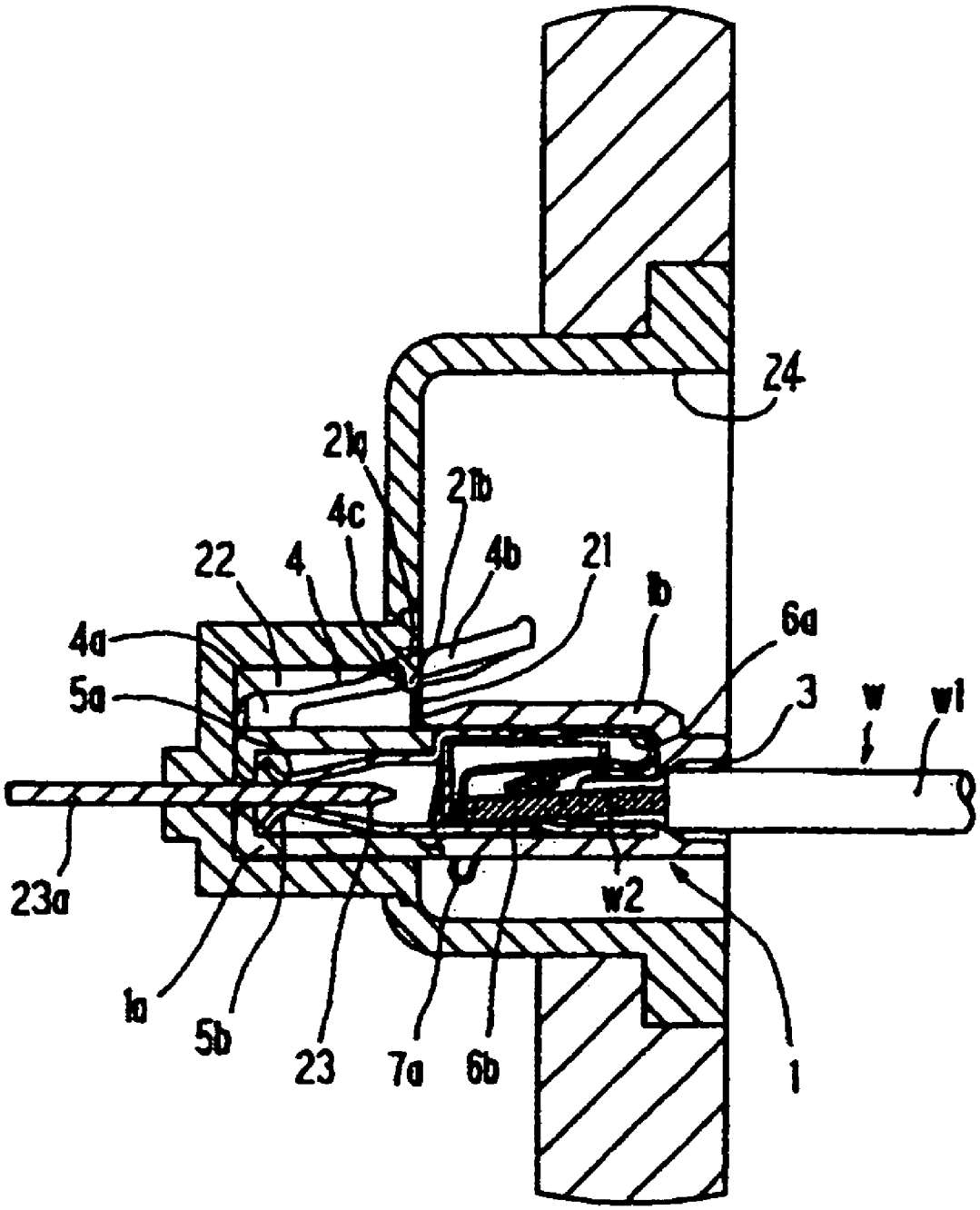
FIG. 9 is a sectional view showing a state wherein the first example of a plug according to the present invention has been connected to a speaker terminal in a speaker box.
Figure 10:
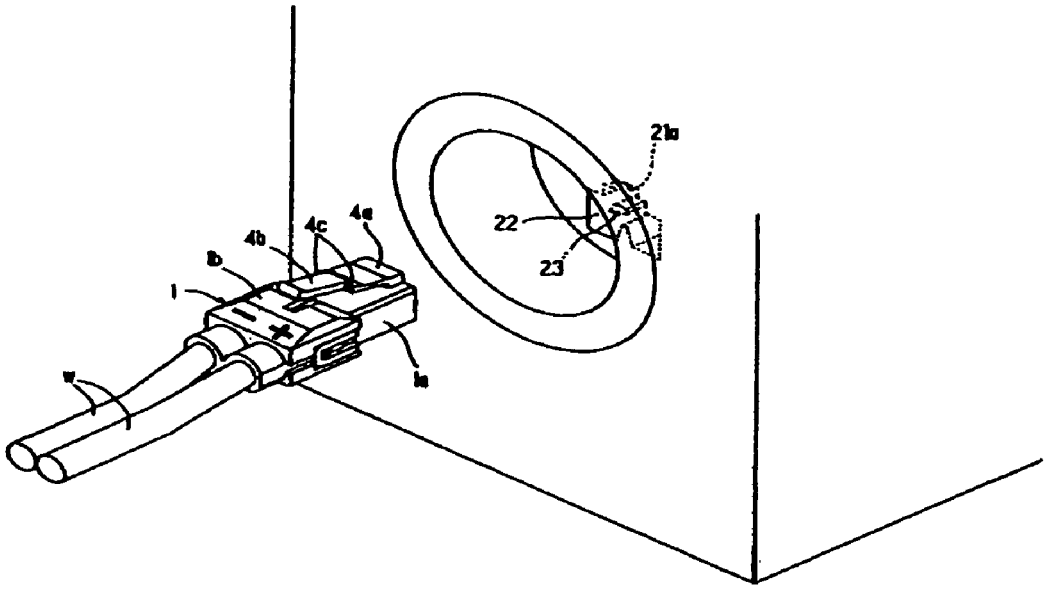
FIG. 10 is a perspective view showing a state of connection in FIG. 9.
Figure 11:
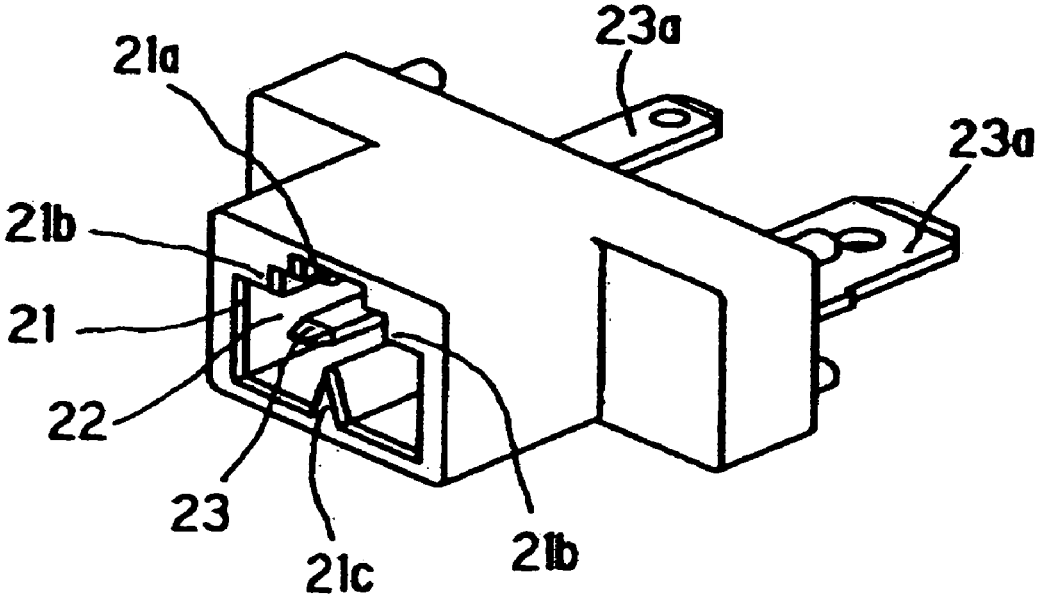
FIG. 11 is a perspective view showing a speaker terminal according to the present invention wherein it has been defined in the form of a single loading slot for a plug.
Figure 12:
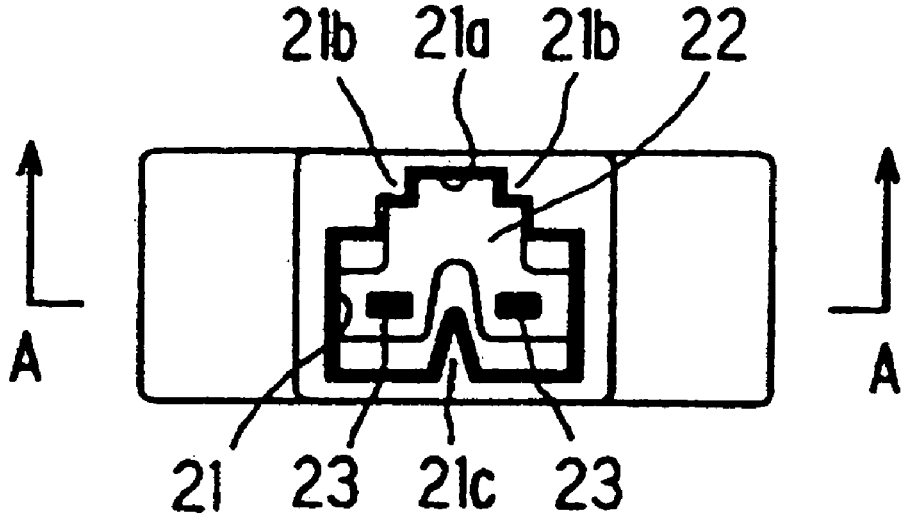
FIG. 12 is a front view showing the speaker terminal of FIG. 11.
Figure 13:
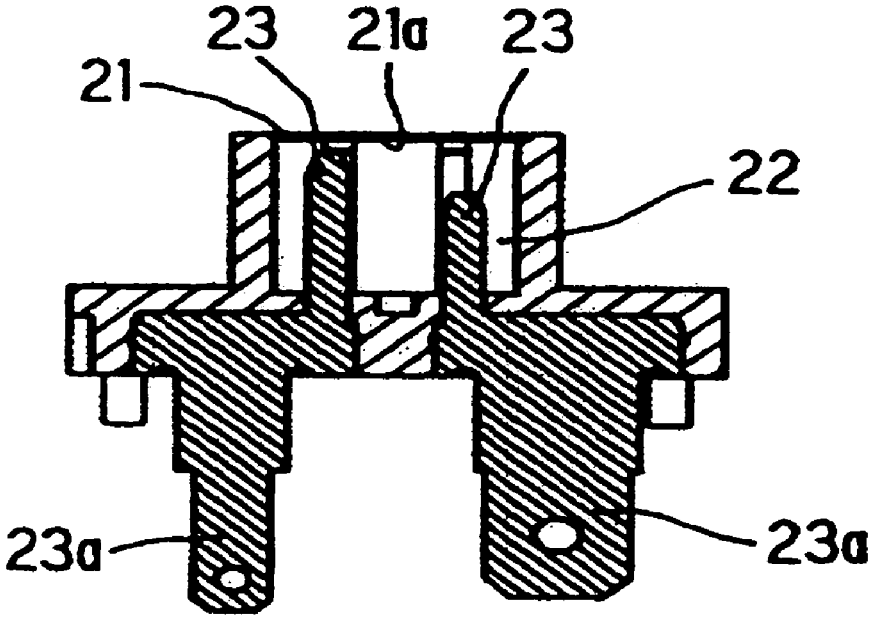
FIG. 13 is a sectional view taken along the line A—A of FIG. 12.

Preferred embodiments of a plug for cables and a speaker terminal and a speaker terminal system provided with them according to the present invention will be described hereinafter by referring to the accompanying drawings. FIG. 1 is a perspective view showing schematically an outline of a home theater system; FIG. 2 is an enlarged side sectional view showing an example of a plug for speaker cables according to the present invention; FIGS. 3A, 3B, 3C and 3D are explanatory views for illustrating each of states in which a speaker cable is connected to an example plug according to the present invention, wherein FIG. 3A is a side sectional view showing a state in which connection has not yet been made; FIG. 3B is a side sectional view showing a state in which an operating piece for releasing the cable has been pushed up by a finger; FIG. 3C is a side view showing a state in which the cable has been inserted into the plug while maintaining the state shown in FIG. 3B; and FIG. 3D is a side view showing a state in which the finger has been removed from the operating piece to complete a connection of the cable with the plug; FIG. 4 is a sectional view showing a second example of a plug according to the present invention; FIG. 5 is a sectional view showing a third example of a plug according to the present invention; FIG. 6 is a sectional view showing a state wherein plugs of the first example according to the present invention are connected to a first example of a speaker terminal according to the present invention; FIG. 7 is a perspective view showing the speaker terminal of FIG. 6; FIG. 8 is a perspective view showing a state of the connection of FIG. 6; FIG. 9 is a sectional view showing a state wherein the first example of a plug according to the present invention has been connected to a speaker terminal in a speaker box; FIG. 10 is a perspective view showing a state of connection in FIG. 9; FIG. 11 is a perspective view showing a speaker terminal according to the present invention wherein it has been defined in the form of a single loading slot for a plug; FIG. 12 is a front view showing the speaker terminal of FIG. 11; and FIG. 13 is a sectional view taken along the line A—A of FIG. 12.

FIG. 1 is a perspective view for explaining an example of a home theater system, which is called by the name of 5.1 channel, composed of a display screen Sc made of liquid crystal panel, CRT or the like; a DVD (digital video disc) player P1 in this case, which functions to project a screen image on the display screen Sc; front loud speakers FS1 and FSr having left and right channels, respectively, and rear loud speakers RS1 and RSr having left and right channels, respectively, which are disposed at four corners of a listening room R; a center loud speaker Cs disposed in front of a listener M; and a subwoofer Su wherein input terminals of the respective loud speakers are connected to output terminals for loud speakers (not shown in FIG. 1) of an amplifier in the above-described player P1 through speaker cables w, respectively.

In order to connect six loud speakers to output terminals for loud speakers in the DVD player P1 as described above, it is necessary to pay close attention so as not to make a mistake as to the polarities of the respective loud speakers, and further, it is necessary to be careful to connect appropriately the speaker terminals of respective channels with predetermined output terminals. However, a speaker terminal system by which the above-described stringent requirements can be satisfied has not been found heretofore as mentioned above.

Moreover, the speaker cables w, each of which connects an input terminal of a loud speaker to an output terminal for a loud speaker of the amplifier, have different lengths, respectively, dependent upon a dimension of the listening room R, and disposed positions of respective loud speakers. Accordingly, such manner that a plug for cables should be connected with the cables w after adjusting the lengths of the cables w, respectively, has been required heretofore. In this respect, however, a plug for speaker cables by which the cables w can be satisfactorily connected and disconnected easily and exactly to and from the plug used therefor has not yet been proposed as mentioned above.

Accordingly, the present invention provides a plug for speaker cables, a speaker terminal for connecting the plug with the speaker cables, and a speaker terminal system composed of the above-described plug and the speaker terminal, which can overcome the above-mentioned problems, and will be described hereinafter.

First, an example of a plug for speaker cables according to the present invention will be described by referring to FIG. 2 to FIGS. 3A to 3D, wherein a plug main body 1 has a substantially square contour in its right section and a hollow interior, two terminal loading slots 2 being aligned horizontally (only one is shown in the figures) on the front side thereof (the left in the drawing of FIG. 2), and two cable loading slots 3 being aligned horizontally in response to the terminal loading slots 2 on the rear side thereof (the right in the drawing).

In the above structure of the plug main body 1, the cable loading slot 3 is narrowed from the entrance towards the interior thereof to define a tapered narrow opening 3*a* such that a covering section w1 of a cable w does not intrude into the inside of the plug main body 1. The above-described plug main body 1 has a two-piece structure composed integrally of a front section of plug 1*a* and a rear section of plug 1*b*. In this respect, however, the invention is not limited to the structure shown in these figures.

An engaging lever 4 is disposed on the top surface of an extreme end side of the front section la in the above-described plug main body 1. The engaging lever 4 functions to engage the plug main body 1 to maintain the same therein when the plug is inserted into a terminal slot of a speaker terminal, which is mentioned hereunder. On the engaging lever 4, an extreme end 4*a* thereof is integrally formed with the front section 1*a* of the plug main body 1, and a section towards the rear direction therefrom is formed into a lever main body 4*b*, which bends elastically. Engaging stops 4*c*, which are engaged by stepped portions (engaging projections) in a loading slot of the plug, which is mentioned later, are formed on right and left sides in an intermediate part of the lever main body 4*b*.

Inside the plug main body 1, tongues for holding a terminal 5*a* and 5*b* are disposed vertically relative to the two horizontal terminal loading slots 2, and tongues for holding a cable 6*a* and 6*b* are linked to the tongues for holding a terminal 5*a* and 5*b*. Furthermore, these tongues for holding a cable 6*a* and 6*b* are disposed vertically inside the rear section 1*b* of the plug main body 1 relative to the two horizontal cable loading slots 3.

The tongues for holding a terminal 5*a* and 5*b* define a narrowed portion 51, which is tapered towards extreme ends of the tongues 5*a* and 5*b*, so as to hold pressingly a terminal to be inserted there into along a vertical direction due to spring action derived from the material for fabricating these tongues.

On the other hand, the tongue 6*a* of the tongues for holding a cable 6*a* and 6*b* is made of a substantially hairpin-shaped elastic member, while the tongue 6*b* is integral with the tongue for holding a terminal 5*b* and provided with a contact portion 61*b* formed by raising a corresponding portion in contact with a cable.

An operating piece 7 is a member for displacing (deforming) upwards the tongue 6*a* against an always-depressing posture thereof, which is due to the elasticity of the material for fabricating the tongue 6*a*. The operating piece 7 is coupled to the end of the tongue for holding a cable 6*a* at the middle position thereof, and an operating portion 7*a* is formed in a near side of the operating piece 7 so as to project from the lower surface of the plug main body 1. Reference numeral 7*b* indicates a coupling portion, where the operating piece 7 is coupled to the end of the tongue for holding a cable 6*a*, and 7*c* designates a partition defined by the operating piece 7. An example of a plug for cables according to the present invention is fabricated as mentioned above.

A manner for connecting a cable w to a plug for cables according to the present invention fabricated as mentioned above is described by referring to FIGS. 3A through 3D, wherein FIG. 3A is a side view showing an internal state in the plug of the present invention in which the cable w has not yet been connected, so that the operating piece 7 is in a state wherein it has been depressed towards the lower side of the plug main body 1 by the elastic force of the tongue for holding a cable 6*a*.

In this condition, a coating w1 is removed from a part of the cable w to be connected to the plug to expose a stranded wire w2, and the resulting cable w is inserted through the loading slot 3 for the plug main body 1. In this case, the operating portion 7*a* in the operating piece 7 is pushed up by an operator's finger, whereby the tongue 6*a*, which has been expanded due to elasticity, is raised at the coupling portion 7*b* (see FIG. 3B).

As a result, a part of stranded wire of the cable w can be inserted into the inmost recess of the plug main body 1 through the loading slot 3 without any accompanying resistance. The insertion is made until the approach of the extreme end of the coating w1 in the cable w is prevented by the narrowed opening 3*a* (see FIG. 3C). It is to be noted that an approach stopper 1*c* is disposed at a boundary part of the front section 1*a* and the rear section 1*b* in the plug main body 1 for the sake of preventing a short-circuit with an adjacent terminal of an inverse polarity as a result of the forward end of the stranded wire w2 approaching the forward side of the plug main body 1 due to a part of the stranded wire w2 being too long. In this sense, the plane of the partition 7*c* defined by the operating piece 7 has a function for preventing a short-circuit.

When the stranded wire w2 of the cable w is inserted to a predetermined position inside the plug main body 1, the operator's finger is removed from the operating piece 7, which has been raised by the finger, an extreme end 61*a* of the tongue for holding a cable 6*a* abuts the upper surface of the stranded wire w2 due to spring action of the tongue for holding a cable 6*a*, and, at the same time, the lower surface of the stranded wire w2 is pressed against the contact portion 61*b* of the tongue for holding a cable 6*b* by the above-described spring action. In this case, since both the extreme end 61*a* of the tongue 6*a* and the contact portion 61*b* of the tongue 6*b* are inclined along a direction of inserting the stranded wire w2, they function as a part for preventing withdrawal in the event of a withdrawing action. Thus, a state of connection wherein the cable w has been connected electrically and mechanically to a plug according to the present invention is realized in a situation shown in FIG. 3D.

Although the above description has been made regarding a situation wherein a cable w having either polarity has been connected to a plug for cables according to the present invention, it is to be noted that another cable having the other polarity, which has not been shown, can be connected to another tongue for holding another cable having the other polarity, which has been formed in the above-described plug main body 1 in accordance with quite the same manner as described above.

While a plug for speaker cables according to the present invention as mentioned above relates to an example wherein a stranded wire w2 of a cable w is held between tongues for holding a cable 6*a* and 6*b* by the use of spring force of the tongue 6*a*, there are plugs for holding cables which do not utilize spring force as described above in their manner for holding the stranded wire w2. As specific examples of such plugs for holding cables are mentioned above, FIG. 4 is one wherein rear half sections of tongues for holding terminals 5*a* and 5*b* are extended and formed integrally to constitute forcibly holding sections 62*a* and 62*b* for the stranded wire w2, and the stranded wire w2 is held between the holding sections 62*a* and 62*b* to be forcibly in contact with both the members. FIG. 5 is a sectional view showing a plug wherein a pressing spring contact piece 63, which is elevated by a screw 64, is disposed on a side of the tongue for holding a cable 6*b*, and when the pressing spring contact piece 63 is forcibly elevated by the screw 64, an inserted stranded wire w2 is compressed to a side of a plate-like holding tongue 6*a*', which has been disposed on the upper part of the plug to hold a cable. In either of the above-described plugs, a contour of a front section 1*a* and a shape of the engaging lever 4 in the plug main body 1 are the same as that of the plug according to the present invention, which has been explained hereinabove.

In the following, an embodiment of a speaker terminal for accommodating a plug for cables of the present invention as constituted above is described by referring to FIG. 6 to FIG. 13.

In FIGS. 6, 7, and 9, reference numeral 21 designates an opening for speaker terminals of the present invention, which has been defined in a sectional profile having a substantially same internal perimeter as a right sectional profile including a front section 1*a* of a plug main body 1, and a front end 4*a* of an engaging lever 4, which is integral with the front section 1*a*. The opening 21 is defined as a box-shape with a recessed configuration such that a substantially same section is maintained from the outermost opening 21 to the innermost recess thereof to constitute a plug loading slot 22. A contact piece 23 for a speaker terminal to be held vertically by tongues for holding a speaker terminal 5*a* and 5*b* in a plug according to the present invention is disposed on an erect wall 22*a* positioned in the inmost recess of the plug loading slot 22 in a direction of the opening 21 in a horizontal posture.

The contact piece 23 is arranged as shown in FIGS. 11 and 12 such that two members of the contact piece 23 used for positive and negative polarities are disposed in parallel to each other in one plug loading slot 22 in a horizontal posture.

Furthermore, the contact pieces 23 and 23 of both polarities are arranged as shown in FIG. 13 such that an extreme end of the contact piece having positive polarity is positioned farther from the opening 21 than an extreme end of the contact piece having negative polarity, whereby noise generation is prevented at the time of connecting a plug. Moreover, the positioning of these contact pieces 23 functions to prevent the possibility that a test finger would contact the contact pieces 23 and 23 in cooperation with a front shape of the opening 21, which is mentioned hereunder.

Reference numeral 23*a* designates a connecting piece formed integrally with a contact piece 23 having either polarity, and it is connected to an output circuit of an amplifier and the like or an input terminal of a loud speaker.

The opening 21 has a substantially convex shape in the front thereof, which corresponds to an outline of a section of the front section 1*a* of the plug main body 1 and the front end 4*a* of the engaging lever 4 in a plug to be inserted according to the present invention, and further formed with a concave region 21*a* in response to the lever main body 4*b* in the engaging lever 4 and a convex region 21*b* (an engaging projection) for engaging the engaging portion 4*c* formed on the lever main body 4*b*, whereby an example of a speaker terminal according to the present invention is obtained.

In the case where a speaker terminal of the present invention is formed as an output terminal for a speaker, plug loading slots 22 for speaker terminals forming right and left channels are disposed in a vertically symmetrical direction as shown in FIG. 6. Accordingly, speaker terminals of the present invention utilized as output terminals with respect to six speakers for 5.1 channels illustrated in FIG. 1 exhibit such a mode that total six plug loading slots 22 composed of vertically symmetrical three sets of plug loading slots are formed into one terminal block with a mode illustrated in FIG. 7.

Hence, speaker terminals of the present invention, which are utilized as output terminals for a loud speaker in audio output equipment such as the DVD player P1, vary from a terminal for at least one channel (two plug loading slots 22) to a terminal for an arbitrary number of channels (the number of plug loading slots 22 corresponding thereto).

On one hand, in the case where a speaker terminal of the present invention is utilized as an input terminal of a speaker such as a speaker box, it may be a speaker terminal of the present invention having one plug loading slot or more 22 as shown in FIG. 10. As described above, even if a speaker terminal of the present invention is utilized as an output terminal or an input terminal, either of them has the same mode as a terminal with only different numbers of plug loading slots 22.

In examples shown in FIGS. 7 and 11 wherein speaker terminals of the present invention are utilized as output terminals, a substantially chevron convex region 21*c* is formed on a side on which the concave region 21*a* and the convex region 21*b* have not been formed in the opening 21. The convex region 21*c* corresponds to a v-shaped valley (not shown) on a side corresponding to that (the bottom wall side in FIG. 2) of the plug main body 1. The convex region 21*c* functions as a guide for insertion and removal of a plug, and functions further to prevent contact of a test finger with respect to the contact piece 23. A manner for inserting a plug of the present invention into a speaker terminal of the present invention constituted as described above is as follows:

First, a front end of the front section 1*a* and the front end 4*a* of the lever member 4 in the plug main body 1 are accommodated in the opening 21 of the speaker terminal of the present invention, and these members are inserted in the inmost recess of the plug loading slot 22. In this case, since the lever main body 4*b* of the engaging lever 4 is depressed downwards by the convex region 21*b* in the opening 21 until the engaging portion 4*c* passes through the convex region 21*b*, the lever main body 4*b* is inserted downwards to be elastically deformed while bending. When the engaging portion 4*c* of the lever main body 4*b* passes through the convex region 21*b*, a rear part of the lever main body 4*b* enters instantaneously into the concave region 21*a*, so that a bending state of the member changes instantly to its original state, because the lever main body 4*b* has been narrowed towards its rear part from the engaging portion 4*c*. At this moment, a "snap" sound is audible, and an operator can sense a clicking feeling of completion of inserting the plug by the operator's fingers and ears. Thus, the engaging portion 4*c* abuts against a backside of the convex region 21*b* to be completely latched, so that the plug cannot be withdrawn.

In the case of withdrawing the above-described plug of the present invention from the plug loading slot 22, a rear portion of the engaging lever 4 is depressed by a finger, so that a situation wherein the engaging portion 4*c* can descend below the convex region 21*b* is realized, and the plug may be withdrawn toward an operator's near side while maintaining this situation.

FIG. 9 illustrates an example wherein a speaker terminal of the present invention shown in FIG. 6 is utilized as output terminals for six speakers of 5.1 channels shown in FIG. 1. More specifically, FIG. 9 illustrates a situation wherein all the speakers other than a front, right channel speaker FSr have been completely connected to speaker terminals of the present invention by the plugs of the present invention, and a plug of the remaining front, right channel speaker is intended to connect to a corresponding speaker terminal.

FIGS. 8 and 10 illustrate an example wherein speaker terminals of the present invention are utilized as input terminals of a speaker box. In this case, when plugs for speaker cables of the present invention are inserted into plug loading slots 22, the loud speaker is connected with speaker output terminals of audio equipment. In FIG. 9, reference numeral 24 designates a housing, which has been attached to a speaker box, wherein speaker terminals of the present invention have been disposed. In FIGS. 6 to 10, it is to be noted that the same or equal members and the same or equal parts are designated by the same reference characters throughout the drawings. A speaker cable terminal according to the present invention comprises the above-described plugs for speaker cables and the speaker terminals.

In a speaker terminal of the present invention as described above, it is desired that edges or peripheries of respective opened portions are colored separately in order to prevent the occurrence of erroneous connections among channels. A shield plate 25 may be applied to the front of a panel in which respective openings 21 have been provided for a countermeasure of noise in digital equipment.

The present invention, which has been constituted as described, has a structure wherein a speaker cable can be attached and detached by one-touch operation in a plug for speaker cable, so that the cable to be used later can be easily changed. Furthermore, since a plug according to the present invention involves an engaging lever bending elastically, connection with respect to a speaker terminal can be confirmed with an appropriate feeling in the case of engaging an engaging portion of the engaging lever with respect to an inserting convex region of the plug due to the elastic action of the lever. Also, removal of the plug cannot be made without an accompanying further action. For removal of the plug, it is necessary to depress the lever, so that there is no fear of erroneous removal due to external force. Moreover, since right sections are formed into asymmetrical small areas in a plug for cables according to the present invention, it becomes possible to arrange speaker terminals used for multiple channels in a space-saving manner.

On the other hand, in order to avoid erroneous insertion of a plug as to its polarity, an opening and a plug loading slot together with a plug are formed into vertically and horizontally asymmetrical right sections, and further, they are disposed symmetrically in right and left channels. As a result, the space efficiency of these members is improved, and even speaker terminals of multiple channels can be contained in a small space. Besides, there is no practical problem in even the case where multichannel terminals are disposed in a small space, because the channels are colored separately to prevent the occurrence of erroneous connection, and shield plates are disposed for a countermeasure of noise.

What is claimed is:

1. A speaker terminal, comprising a plug for speaker cables that comprises:

a plug main body involving terminal loading slots for positive and negative polarities on the front thereof, loading slots for cables in response to said both polarities in the rear thereof, and a hollow inside thereof;

tongues for holding terminals functioning to hold speaker terminals inserted from said terminal loading slots from the external surface thereof by spring action; and tongues for holding cables coupled to said tongues for holding terminals and functioning to hold stranded wires of speaker cables inserted from said cable loading slots from the external surface thereof by spring action, said tongues for holding cables being operated so as to expand sections for holding cables by operating pieces disposed so as to be exposed outside said plug main body, respectively;

and further comprising:

one or more plug loading slots each having a front end of which opens into a substantially same sectional shape as a sectional contour of a plug for speaker cables to be inserted, wherein said slots comprise a top, a bottom and right and left sides;

an engaging projection for latching and supporting an engaging portion of an engaging lever of a plug to be inserted and that is disposed at the front end of an opening edge in said respective plug loading slots; and contact pieces of terminals of positive and negative poles for speakers being disposed on an inmost recessed wall surface of said plug loading slots so as to be horizontal with respect to the front end of said opening, said contact pieces exhibiting the same shape;

wherein an opening wall of said front end of said plug loading slot engages and supports the engaging portion of the engaging lever of the plug to be inserted;

wherein at least one of said top, bottom and right and left sides includes a convex region that guides insertion and removal of a plug, and further prevents inadvertent contact with the contact pieces; and wherein said plug loading slot is asymmetrical between said top and said bottom sides so that said plug can be inserted in only a single position relative to said slot; and wherein extreme ends of contact pieces of terminals of positive and negative poles are disposed with a difference in their distances from the front end of the opening in said plug loading slots.

2. A speaker terminal according to claim 1, comprising at least two plug loading slots, wherein said plug loading slots are disposed in symmetrical disposition.

3. A speaker terminal according to claim 1 wherein front external surfaces of said plug loading slots for respective channels are colored separately.

4. A speaker terminal according to claim 1 wherein a shield plate is disposed in the front surface thereof except for each of said plug loading slots.

5. A speaker terminal according to claim 1 wherein said convex region is V-shaped.

6. A speaker terminal, comprising:

one or more plug loading slots each having a front end of which opens into a substantially same sectional shape as a sectional contour of a plug for speaker cables to be inserted, wherein said slots comprise a top, a bottom and right and left sides;

an engaging projection for latching and supporting an engaging portion of an engaging lever of a plug to be inserted and that is disposed at the front end of an opening edge in said respective plug loading slots; and contact pieces of terminals of positive and negative poles for speakers being disposed on an inmost recessed wall surface of said plug loading slots so as to be horizontal with respect to the front end of said opening, said contact pieces exhibiting the same shape;

wherein an opening wall of said front end of said plug loading slot engages and supports the engaging portion of the engaging lever of the plug to be inserted;

wherein at least one of said top, bottom and right and left sides includes a convex region that guides insertion and removal of a plug, and further prevents inadvertent contact with the contact pieces;

wherein said plug loading slot is asymmetrical between said top and said bottom sides so that said plug can be inserted in only a single position relative to said slot;

wherein extreme ends of contact pieces of terminals of positive and negative poles are disposed with a difference in their distances from the front end of the opening in said plug loading slots; and wherein said convex region is V-shaped.

* * * * *